US005947884A

United States Patent [19]

Sasaki et al.

[11] Patent Number: 5,947,884

[45] Date of Patent: Sep. 7, 1999

[54] METHOD OF PRODUCING A BAG FOR CARRY OUT FOOD OR OTHER ARTICLES

[75] Inventors: Shigeya Sasaki; Shinji Kobayashi; Shuichi Gotoh, all of Tokyo, Japan

[73] Assignee: Idemitsu Petrochemical Co., Ltd., Tokyo, Japan

[21] Appl. No.: 08/989,484

[22] Filed: Dec. 12, 1997

Related U.S. Application Data

[62] Division of application No. 08/491,283, Jun. 16, 1995, Pat. No. 5,741,077.

[30] Foreign Application Priority Data

Jun. 17, 1994 [JP] Japan ..... 6-135496

[51] Int. Cl.[6] ..... B31B 1/22

[52] U.S. Cl. ..... 493/232; 493/237; 493/218; 493/226; 493/926; 493/936

[58] Field of Search ..... 493/228, 226, 493/218, 926, 936, 232, 237, 219, 227; 53/373.4

[56] References Cited

U.S. PATENT DOCUMENTS

| | | | |
|---|---|---|---|
| 3,549,451 | 12/1970 | Kugler | 493/219 |
| 3,834,528 | 9/1974 | Pickford et al. | 383/10 |
| 3,987,959 | 10/1976 | Deards et al. | 383/10 |
| 4,588,392 | 5/1986 | Maddock | 493/232 |
| 4,816,104 | 3/1989 | Benoit | 493/232 |
| 5,069,659 | 12/1991 | Bochtler et al. | 493/226 |
| 5,322,450 | 6/1994 | Willing | 493/226 |

FOREIGN PATENT DOCUMENTS

| | | | |
|---|---|---|---|
| 2436719 | 5/1980 | France | 493/219 |

*Primary Examiner*—Peter Vo
*Assistant Examiner*—Matthew Luby
*Attorney, Agent, or Firm*—Flynn, Thiel, Boutell & Tanis, P.C.

[57] ABSTRACT

A carry out bag having a base portion of which opposing two sides are facing each other, first side portions extending from the opposing two sides of the base portion until a middle area of the base portion respectively, and second side portions extending from the first side portions extended until the middle area and toward an opposite direction to that of the first side portions. The other both sides of the first side portions are bonded to the base portion. Putting an article across the both second side portions not to block up the hand grips therewith, and taking out the hand grips to pull out from the article and to separate the second side portions one from the other, so that the article is received in the carry out bag.

9 Claims, 12 Drawing Sheets

METHOD OF PRODUCING A BAG FOR CARRY OUT FOOD OR OTHER ARTICLES

This is a divisional of Ser. No. 08/491 283, filed Jun. 16, 1995. Now U.S. Pat. No. 5,741,077.

BACKGROUND OF THE INVENTION

1. Field of the Invention

This invention is broadly concerned with a carry out bag for receiving therein take out foods, meals, products and articles, a producing method thereof and a using method thereof and intended particularly to be used to simply carry foods such as takeout lunch box, takeout dish, cake, expensive fruit, pizza and sliced raw fish.

2. Description of the Related Art

Various types of carry out bags have previously been used to take out foods to home.

The general carry out bags are used by a store clerk or by the customer to package food items for store removal.

The store clerk or customer, when using such bags now, first opens a new carry out bag using one hand holding the bag open, then places the item in the bag with the other hand. Subsequently, the received position of goods is set. When the goods are a lunch box to be kept flat in the conventional carry out bag, the store clerk or customer adjusts the state of the goods in the carry out bag.

However, this conventional using method of carry out bag requires one to hold the carry out bag in its opening state with one hand and to adjust the state of the goods in the carry out bag with the other hand, which is troublesome especially for store clerks during the time when shoppers rush.

Furthermore, when using a carry out bag produced from synthetic resin, the carry out bags are stacked one on top the other. This way of stacking the bags for use tends to have the bags stick to each other, so that the above-mentioned using method of the conventional carry out bag to open the opening generally takes much time and causes needless delays in the clerk check out.

These conventional carry out bags (like T-shirt bags) are not suitable foods or full meals that require that they be held in a stable orientation when being transported. Lunch boxes, trays, soups and mixed meals that may be spilled or spoiled if tipped should be kept in a proper orientation during transporting.

Based on such inconvenience, there has been proposed to use, for example, a square bottom type carry out bag in order to keep the goods stable though moving.

The square bottom type carry out bag assures stability of the goods therein when moving or carrying, but it may also require much time to be opened and to receive therein goods in the packaging as has been mentioned above.

It is an object of the present invention to provide a carry out bag, a method of producing a carry out bag and a using method of the carry out bag which allows easy opening and packaging and stable transportation of the goods.

It is an another object of the present invention to provide a carry out bag and a using method thereof capable of smoothly opening and packaging even if the goods are large and put thoughtlessly in the bag, and further achieves a stable transportation of the good and a simple production.

SUMMARY OF THE INVENTION

In accordance with the present invention, the claimed bag includes a base portion with opposing two sides that face each other; first side portions extending from the opposing sides of the base portion until a middle area of the base portion, respectively; and second side portions that extend from the first side portions toward an opposite direction to that of the first side portions near or until an outside area of the opposing two sides of the base portion, other both sides of the first side portions being bonded to the base portion.

Incidentally, the side edges of the first side portions are bonded to the base portion in an angular state with reference to the opposing sides of the base portion so that the base portion is formed into a polygon shape such as hexagon or octagon. The base portion may have cut out portions each having a semicircular shape at both side portions in the middle area.

The respective second side portions may be provided with hand grips. The hole shape of the hand grip is preferable to be a curved rectangular hole, but it should not be limitedly considered since it is enough to insert thereinto fingers. These grips can be provided as to be tied to each other by having a triangle, trapezoid or convex shape, otherwise a set of eye and web. The carry out bag is recommended to be made of plastic.

In the present invention, the hand grips are disposed outside of two sides of the base portion at which the first side portions are folded in order to achieve the another object.

In particular, the second side portions are provided with hand grips respectively disposed outside of the opposing two sides of the base portion.

A producing method in accordance with the present invention is characterized to have the following steps: making a base portion which has opposing sides facing each other and is provided in a folded state to meet the opposing sides together and a pair of side portions that extend from the opposing sides; forming four-folded portion inserting the folded base portion between side portions; forming two-folded portion of the side portions whereat the base portion is not inserted; bonding both sides of side portions at the four-folded portion with nearest half-sized side portions of the base portion; folding the respective side portions along a boundary between the four-folded portion and the two-folded portion; and spreading the base portion in a plane to have two sets of three-folded portion.

The bonding step between the side portions and the base portion is angularly carried out with reference to the opposing two sides facing each other. The producing method may further have the step of cutting out outer area at bonded portions before forming the three-folded portion and cutting out both side portions into a semicircular shape at the middle area of the base portion.

Of course, the respective side portions can be provided with hand grips by cutting out. The cut out process for the hand grip may be carried out at the same time when cutting out both side portions at the middle area of the base portion.

The using method according to the present invention is characterized to have the steps of putting an article across both second side portions; and pulling out from under the article and to separate the second side portions one from the other, so that the article seats in the carry out bag.

The second side portions are recommended to be provided with the hand grips at outside of the opposing two sides to pull out the second side portions from under the article so as to be separated each other.

In the present invention, when packaging an article with the carry out bag, the fold lines between the second and first side portions are pulled so as to be separated one from the other to open the carry out bag to thereby receive therefrom the article.

The article is put across both second side portions from above the second side portions and thereafter the second side portions are pulled out in opposed directions to be separated each other and from under the article. Consequently, the article can be completely and automatically packaged in the bag.

The present packaging procedure always assures the placement of the article on the base portion in a flat state without any arrangement of state in the carry out bag. This means that there is no necessity to keep the opening open by one hand, put the article into the carry out bag and arrange the article for transportation.

Accordingly, this bag provides a smooth packaging procedure for store clerks during times when shoppers are rushed.

As the article can be flat on the base portion in the carry out bag the bag offers reliability in transportation for the article. Supposing it is a lunch box, cake, hamburger, or fried chicken served in a simple case made of plastics, paper or wood, it can be kept flat constantly. Similarly, a container of soup will not overflow due to leaning on one side.

Since the respective carry out bags in the present invention can be stored and transported in a state that each bag has the three-folded portion, a sheaf of the carry out bags is rather small to be handled.

When using the carry out bag, the first and second side portions are generally standing up with reference to the base portion via the opposing two sides. It will be further appropriate to expect to provide advertising effect if a sales message is printed on the first side portion and/or the second side portion, particularly on the first side portion, because the side portion and the second side portion are stood straight from the side with reference to the base portion.

The using state of the carry out bag presents a good appearance which further effects advertising effect.

The other sides of the first side portion and the base portion are angularly connected relatively to the opposing two sides of the base portion to form both side walls of the carry out bag with other sides of the base portion to thereby improve the entire appearance and stability in use to thereby develop its reliance to carry the article.

The semicircle notches at both ends of the center line in the base portion improve an opening characteristic of the carry out bag and strengthen portions around the notches. The cut off process of the notches includes the same process for both ends of the center line of the respective heat-bonded portions, which assures fine finish of these ends. The notches further effect to lessen the bulk when plural carry out bags are stacked up, which is advantageous for storing and transporting the bags.

To provide hand grips in the second side portions is to allow an easy transportation of the carry out bag placed therein an article and an effective packaging.

Now, if the hand grips of the second side portions are provided outside of the opposing two sides, the article does not block the hand grips. In this case, the carry out bag is provided to have the hand grips of the second side portions outside of the opposing two sides which are fold lines between the base portion and the first side portions, so that when putting the article on the second side portions, it does not naturally take place to block up the respective hand grips. Accordingly, the hand grips can be picked up to separate both second side portions in the opposed directions respectively to thereby speedup total packaging efficiency.

When the three-folded portion is organized with the base portion, first side portion and a part of second side portion or a part of second portion inside of the opposing two sides, the parts of the second side portions each having the hand grip outside of the opposing two sides are disposed singularly. Accordingly, the hand grips can be cut out of the bag when it is in a three-folded state which simplifies the production steps to thereby achieve the above-mentioned objects.

In production of the carry out bag, after forming the four- and two-folded portions and prior to forming the three-folded portion, outer portions of the otherwise bonded portion between the sides of the first side portion and the base portion are cut out. The cuts are in a semicircular shape. Incidentally, these cut out and cut off procedures can be carried out in the above-mentioned folded state to thereby improve productivity of the carry out bag. The hand grips are easily made cutting of the two-folded portion.

DETAILED DESCRIPTION OF THE PREFERRED EMBODIMENT(S)

Figure 1A:
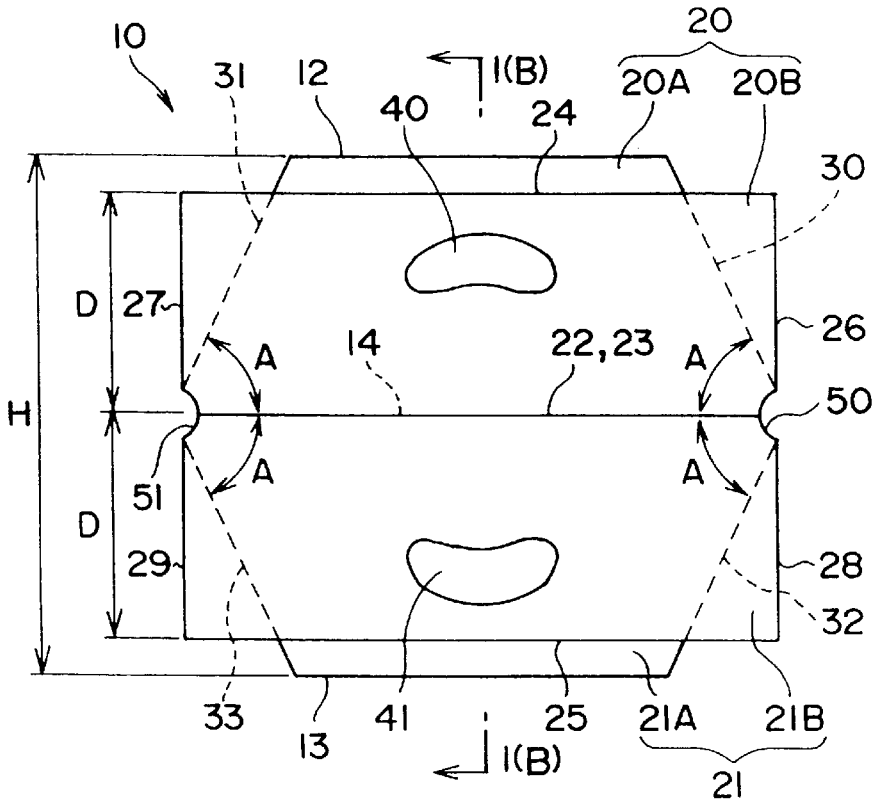
FIG. 1(A) is a plane view in the first embodiment according to the present invention.

The first preferred embodiment of the present invention will now be described with reference to the drawings. Incidentally, in the description of the following embodiments, the same reference numerals will be used to designate the same or similar components as those in the first embodiment, so that duplicate description will be omitted or simplified.

Figure 1B:
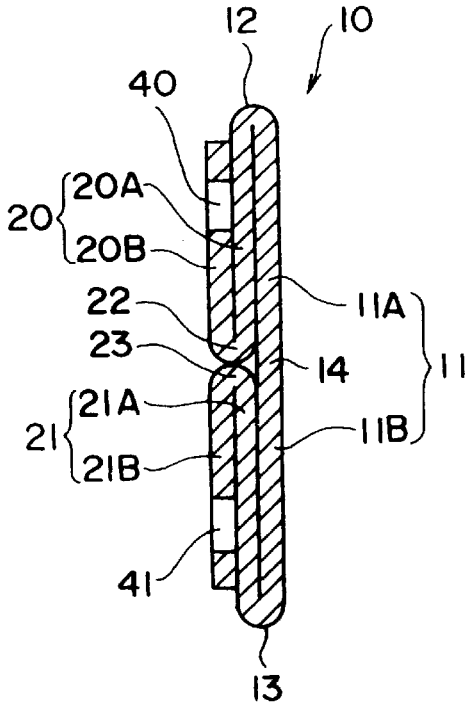
FIG. 1(B) is a sectional view taken along the 1B—1B line in FIG. 1(A)
Figure 2:
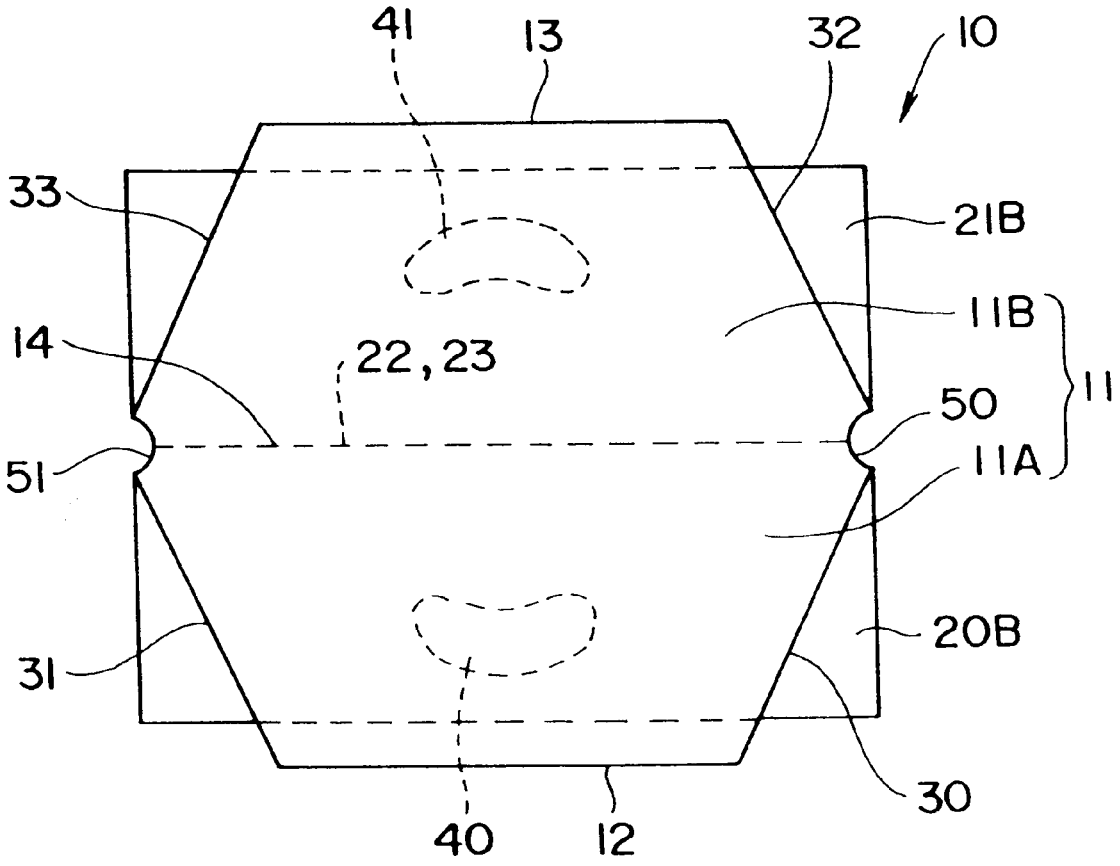
FIG. 2 is a bottom view in the first embodiment.

A carry out bag 10 of the first embodiment according to the present invention is shown in FIGS. 1(A), 1(B) and 2, FIG. 1(A) being of a plane view thereof, FIG. 1(B) being of a sectional view taken along the 1B—1B line in FIG. 1(A), and FIG. 2 being of a bottom view of the same.

As shown in FIGS. 1A, 1B and 2, the carry out bag 10 is produced from plastic film and defined by a base portion 11 having a hexagonal shape like a "shell of a tortoise" and a pair of side portions 20, 21 extending from opposing two sides 12, 13 of the base portion 11 that face each other.

The side portions 20, 21 have two sections folded along fold lines 22, 23, one being the first side portions 20A, 21A and the other being the second side portions 20B, 21B.

The base portion 11 is adapted to be able to be folded along a center line 14 so that the sides 12 and 13 meet each other and two symmetrical trapezoid sections by the center line 14 will be denoted hereunder as base portions 11A, 11B.

The first side portions 20A, 21A should be understood as to each have the similar trapezoid shape as that of the base portions 11A, 11B. The first side portions 20A, 21A are respectively extended from the sides 12, 13 until a central area of the base portion 11, that is, each has half the width H of the base portion 11.

Each second side portion 20B, 21B almost has a rectangular shape which is successively extending from the central area (fold line 22, 23) of the base portion 11 so as to cross the side 12, 13. Accordingly, the width D of the second side portion 20B, 21B is less than the half size of the width H.

The rest sides of the base portion 11A, 11B are respectively heat-bonded (sealed) with rest sides of the first side portions, where will be referred to as a heat-bonded portion 30, 31, 32, 33.

Each heat-bonded portion 30–33 is angularly related at an angle of A to the center line 14 of the base portion 11 or the opposing two sides 12, 13 facing to each other. Incidentally, the angle A is generally in a range of 30–45 degrees.

As can be seen from the drawings, the second side portion 20B, 21B is provided with a crescent-shaped hole as a hand grip 40, 41.

The peripheral portions of the second side portions 20B, 21B such as forward ends 24, 25 and side edges 26, 27, 28, 29 are not restrained with reference to any part of the carry out bag 10.

There are provided notches 50, 51 at both ends of the center line 14 of the base portion 14 or at an adjoining corner of the respective base portions 11A, 11B.

Each notch 50, 51 is cut off to have a semicircular shape as can be seen from FIG. 1(A) when looking from the above. Incidentally, the notches 50, 51 should be understood as to be cut off from the first side portions 20A, 21A and the second side portions 20B, 21B, too.

Figure 3:
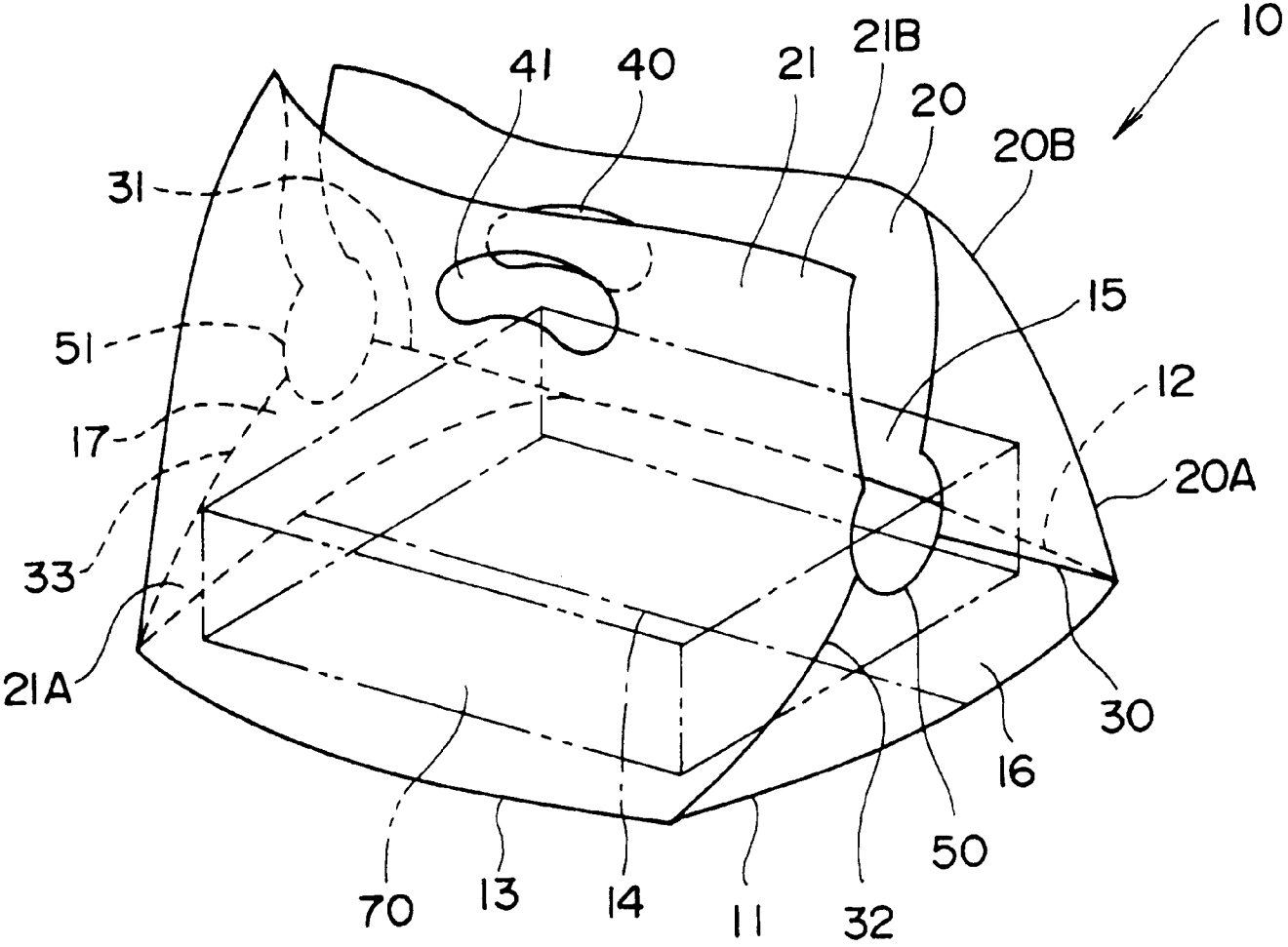
FIG. 3 is an explanatory view for a packaging method in the first embodiment.

Now referring to FIG. 3, there is shown the carry out bag 10 in use according to the present invention, in which the opening is opened enough and an article 70 is depicted by two-dotted lines as have already been packaged in the carry out bag 10.

The opening 15 of the carry out bag 10 is defined by the fold lines 22, 23 shown in FIG. 1 and can be formed when the respective second side portions 20B, 21B are pulled out to separate one from the other.

As shown in FIG. 3, the carry out bag 10 in use forms its side walls, that is, a triangle portion 16 of which oblique sides are made by the heat-bonded portions 30 and 32 at the side edges of the base portion 11 and an opposite triangle portion 17 of which oblique sides are made by the heat-bonded portions 31 and 33.

Below, a method of producing the above-explained carry out bag 10 will be explained with the accompanied drawings.

Figure 4:
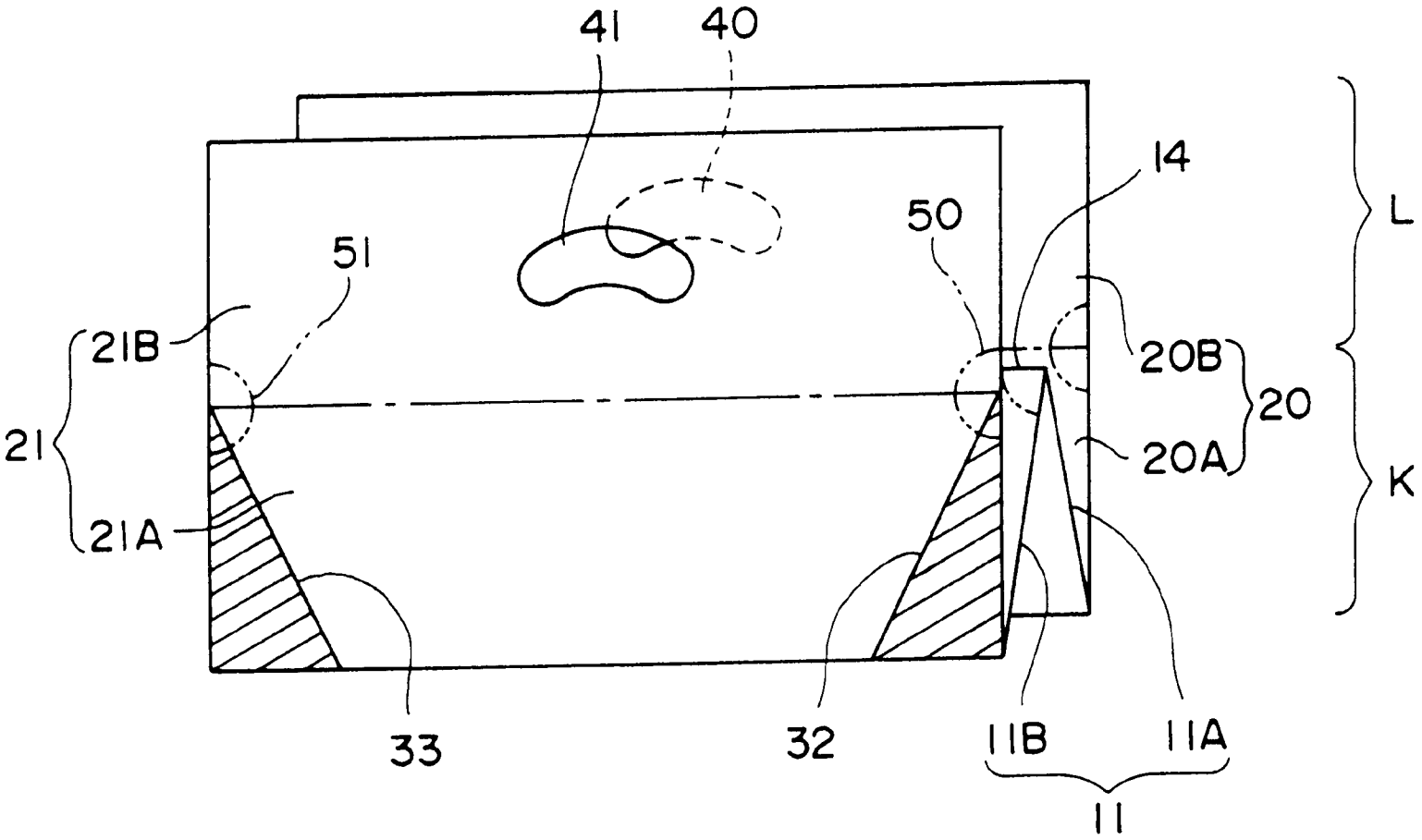
FIG. 4 is an explanatory view for a producing method in the first embodiment.

First, as shown in FIG. 4, a four-folded portion K is prepared with the base portion 11 folded along the center line 14 and the first side portions 20A and 21A as well as two-folded portion L made from the second side portions 20B and 21B. However, the base portions 11A, 11B and the first side portions 20A, 21A are not shaped into the already explained external form and still have a rectangular shape.

Next, the edge portions of the base portions 11A, 11B and the first side portions 20A, 21A are rectangularly heat-bonded altogether to form the respective heat-bonded portions 30–33 as shown in FIG. 4.

Thereafter, the triangle portions outside of the heat-bonded portions 30–33 hatched area in FIG. 4 are cut off.

Each notch 50, 51 is made by cutting off, after the above-explained cut off process at the triangle portion shown by hatching in FIG. 4, into a semicircular shape around both ends of a one-dotted border line between the four-folded portion K and the two-folded portion L. Incidentally, there are also provided notches 50, 51 at both ends of the center line 14 of the base portion 11. The hand grips 40, 41 may be formed in the two-folded portion L by cutting out holes in the second side portions 20B, 21B altogether.

Figure 5A:
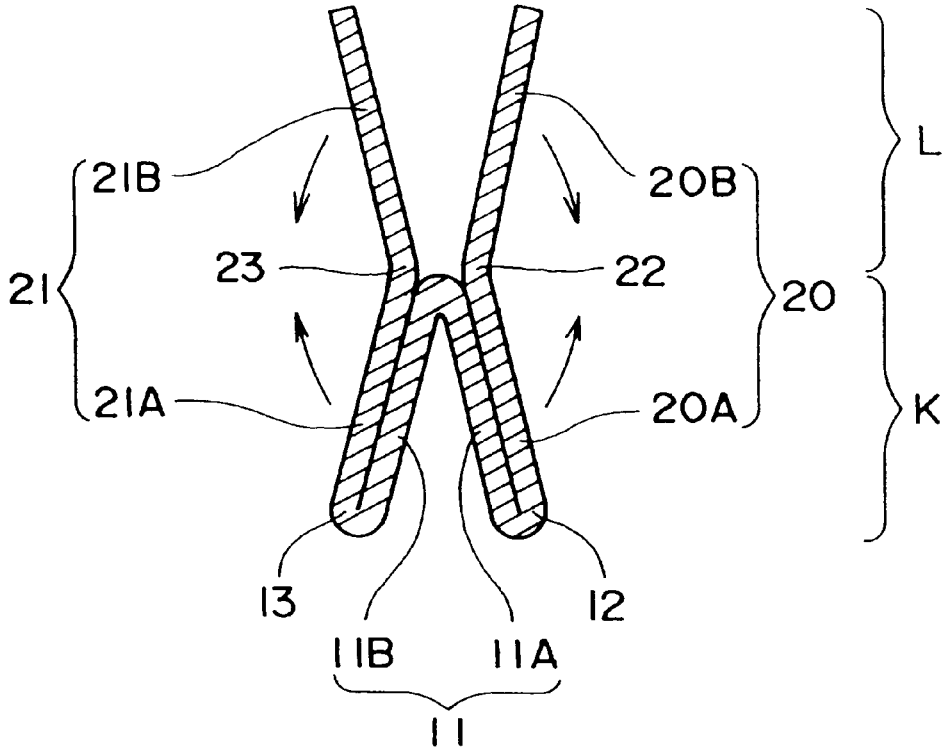
FIGS. 5(A), 5(B) are other explanatory views for the producing method in the first embodiment.
Figure 5B:
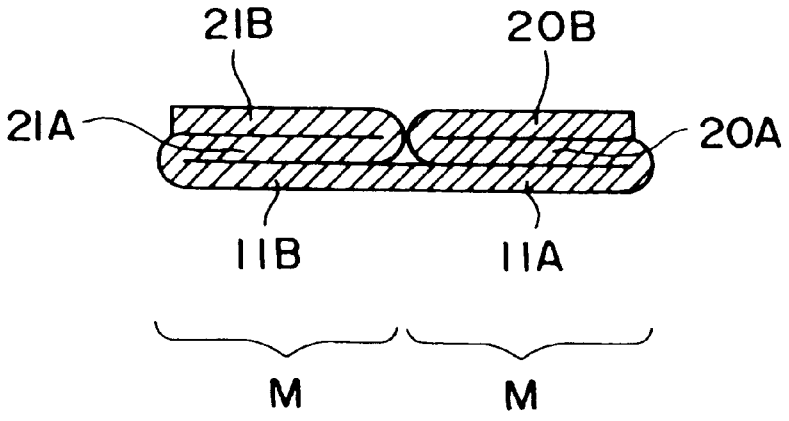

Successively, the carry out bag shown in FIG. 4 will be further processed as shown in FIGS. 5(A) and 5(B), that is, the side portion 20, 21 is folded along the fold line 22, 23 described with one-dotted line and the two-folded base portion 11 is spread in almost flat state to thereby form two sets of three-folded parts M, each consisting of the base portion 11A, 11B, first side portion 20A, 21A and the second side portion 20B, 21B in this order.

A preferable using method of the carry out bag 10 according to the present invention will hereunder be explained.

The article, such as lunch box 70, to be packaged is put on the carry out bag so that it is disposed on the second side portions 20B, 21B, across the fold lines 22, 23.

When packaging, the second side portions 20B, 21B are pulled out to be separated one from the other or in directions designated by the arrows E and F as to draw out the respective side second portions 20B, 21B caught under the article 70.

The drawn out both second side portions 20B, 21B are pulled up straight with reference to the base portion 11 until to join the hand grips 40 and 41 together as shown in FIG. 3.

The above-described first embodiment assures the following effects.

The only required operation is to pull out the second side portions 20B, 21B laterally to separate one from the other after simply putting the article 70 on the second side portions 20B, 21B, so that the whole packaging procedure can be completed with opening the opening of the carry out bag 10, which effects smooth packaging for a store clerk during crowded shopping times.

The user is not required to seat the article 70 in the carry out bag 10 later because the article 70 is smoothly and automatically seated on the base portion 11 by carrying out the method explained with reference to FIG. 6. Accordingly, it will not be required to keep opening the opening of the carry out bag 10 by one hand seat the article therein after the article is placed in the bag.

It is a further benefit for the shoppers that the article 70 in the carry out bag is made flat on the base portion 11, so that the article can be stably carried by shoppers.

Accordingly, any good of which commercial value is easy to be spoiled when its posture is tilted, such as lunch box, is kept flat and can be reliably carried.

When keeping and transporting the carry out bags 10, a stack thereof is not so big to handle since the three-folded parts M as shown in FIG. 5(B) are affectively arranged.

It will be further appropriate to expect some advertising effect if a sales message is printed on the first side portion 20A, 21A and/or the second side portion 20B, 21B, particularly on the first side portion 20A, 21A, because the side portion 20A, 21A and the second side portion 20B, 21B extend straight from the side 12, 13 with reference to the base portion 11 as can be seen from FIG. 3.

The using state shown in FIG. 3 presents a good appearance which further effects advertising effect.

As mentioned above, the respective heat-bonded portions 30–33 are angularly provided from the sides 12, 13. The triangle portion 16 made by the heat-bonded portions 30 and 32 and the opposite triangle portion 17 made by the heat-bonded portions 31 and 33 form side walls of the carry out bag to improve its appearance and stability in use to thereby develop its reliance to carry the article 70.

The notches 50, 51 at both ends of the center line 14 of the base portion 11 improve an opening characteristic of the carry out bag and strengthen portions around the notches. The cut off process of the notches includes the same process for both ends of the center line 14 of the respective heat-bonded portions 30–33, which assures fine finish of these ends. The notches 50, 51 further lessens the bulk when plural carry out bags 10 are stacked up. This is advantageous for storing and transporting the bags.

Figure 6:
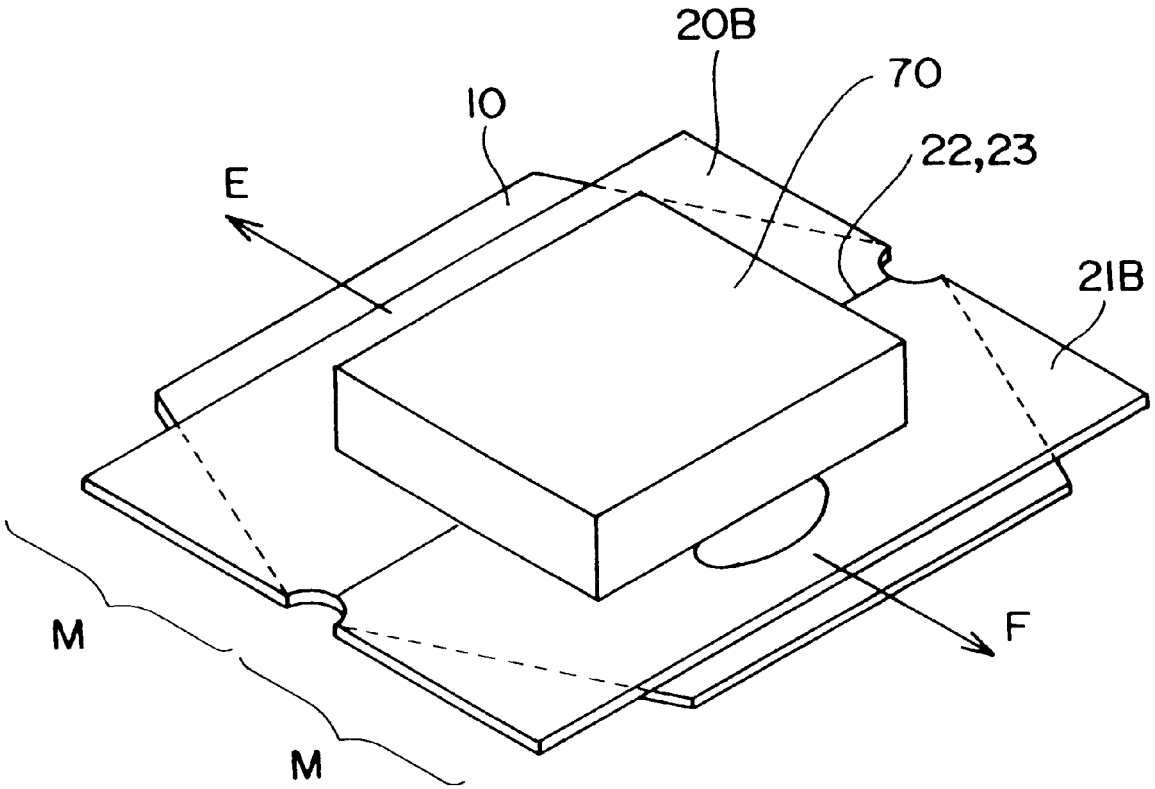
FIG. 6 is an explanatory view for a using method in the first embodiment.

The hand grips 40, 41 are useful to carry the article 70 in the carry out bag and to pull out the respective second side portions 20B, 21B in the opposed direction E or F respectively as shown in FIG. 6 when packaging, whereby the packaging will be improved.

The second embodiment of the present invention will hereunder be described with reference to FIGS. 7–12.

Figure 7A:
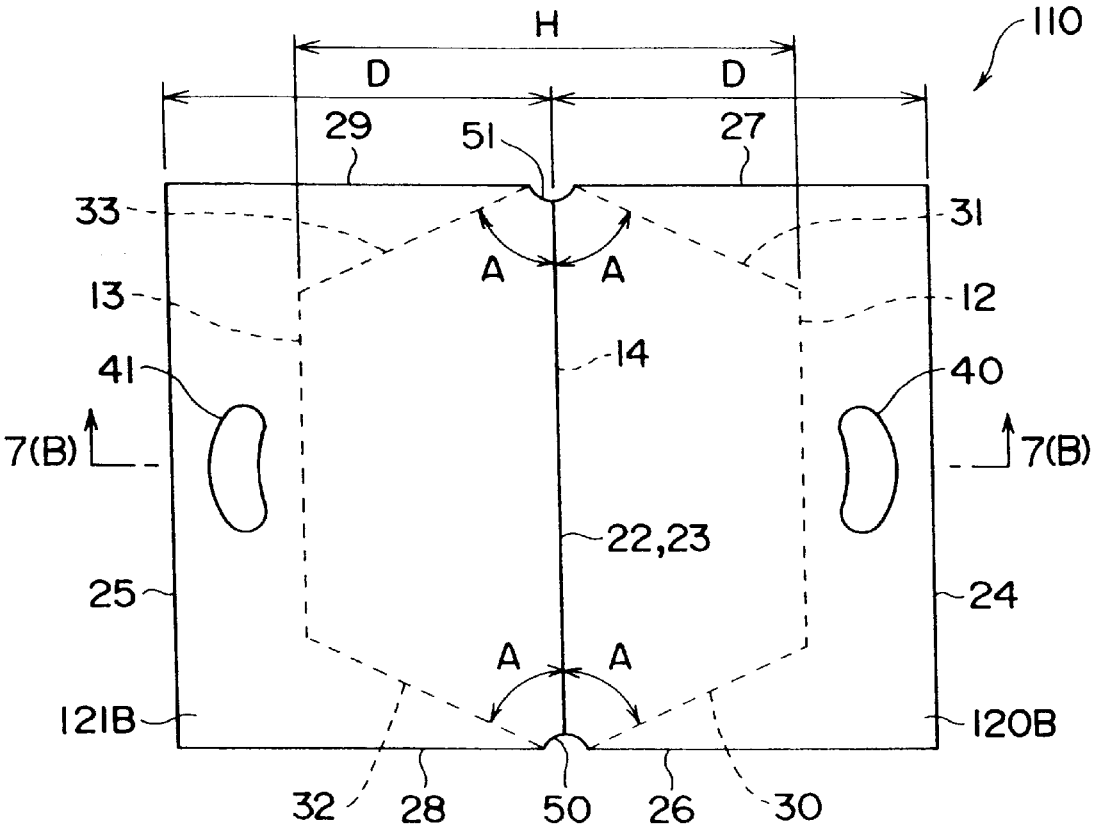
FIG. 7(A) is a plane view in the second embodiment according to the present invention.
Figure 7B:
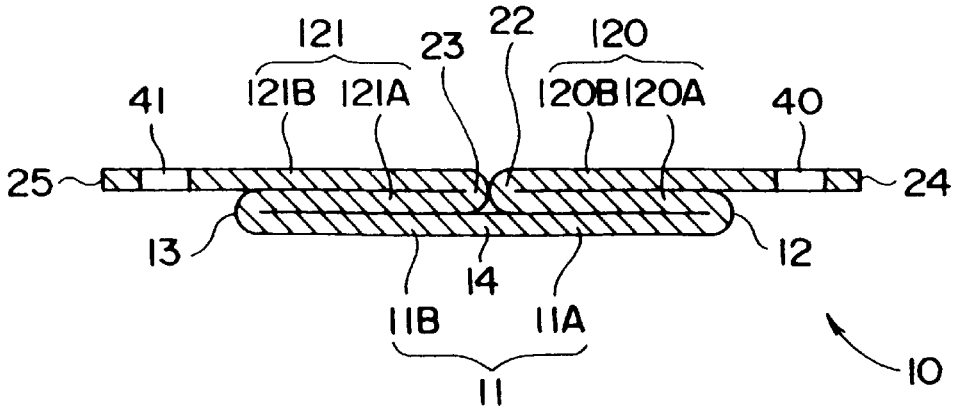
FIG. 7(B) is a sectional view taken along the 7B—7B line in FIG. 7(A)
Figure 8:
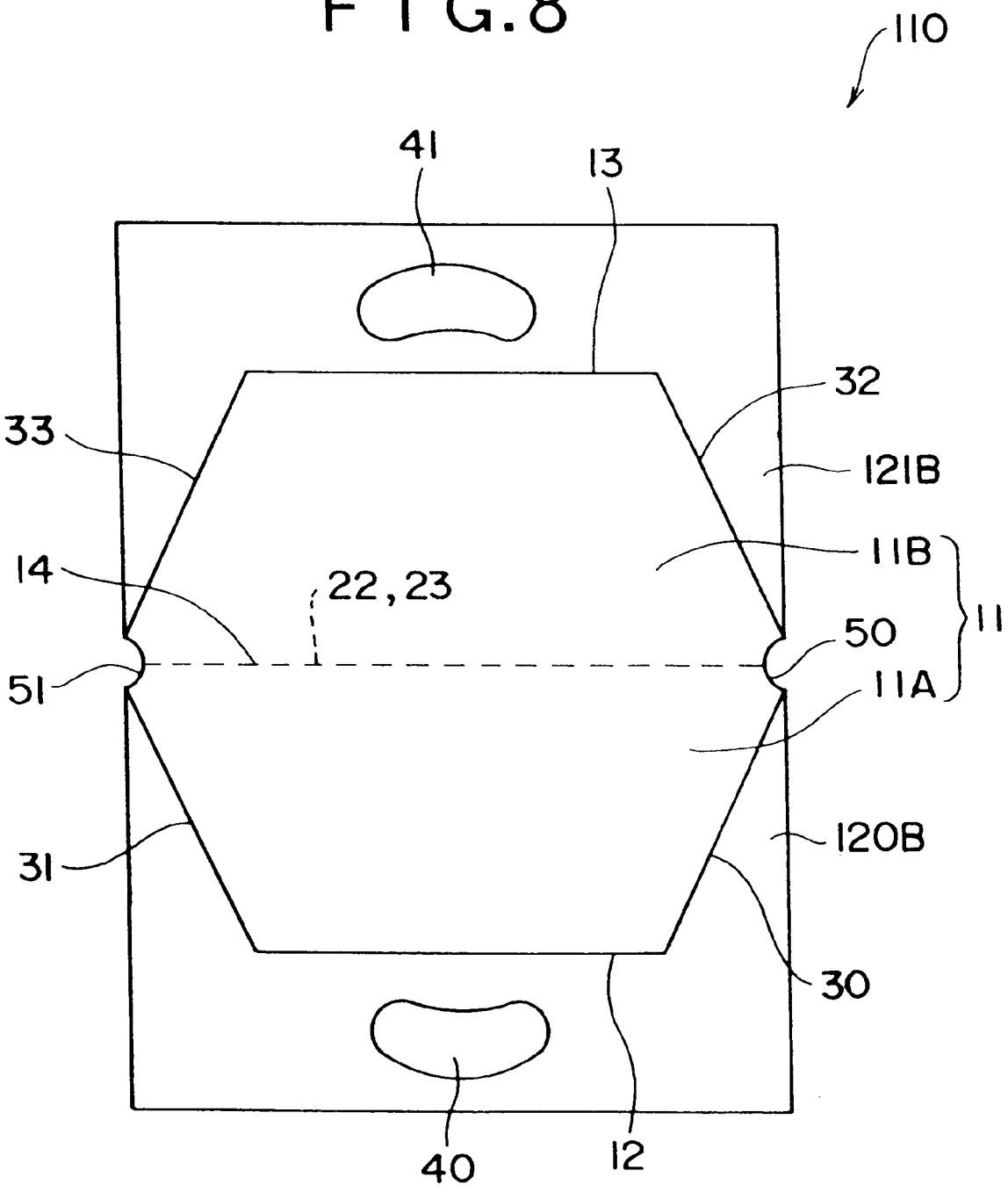
FIG. 8 is a bottom view in the second embodiment.

A carry out bag 110 of the second embodiment according to the present invention is shown in FIGS. 7(A), 7(B) and 8, FIG. 7(A) being of a plane view thereof and FIG. 7(B) being of a sectional view taken along the 7B—7B line in FIG. 7(A), and FIG. 8 being of a bottom view of the same.

As shown in FIGS. 7(A), 7(B) and 8, the carry out bag 110 is produced from plastic film and defined by a base portion 11 and a pair of side portions 120, 121 extending from opposing two sides 12, 13 of the base portion 11 facing to each other.

The side portions 120, 121 each have two sections folded along fold lines 22, 23, one being the first side portions 20A, 21A and the other being the second side portions 120B, 121B.

Each second side portion 120B, 121B almost has a rectangular shape which extends from the central area or a hold line 22, 23 of the base portion 11 so as to cross the side 12, 13. Accordingly, the width D of the second side portion 120B, 121B is larger than the half size width H.

As can be seen from the drawings, the second side portion 120B, 121B is provided with a hole as a hand grip 40, 41 at an outside of the side 12, 13. In the second embodiment, the hand grips 40, 41 are not always required to be provided, as described above, completely outside of the sides 12 and 13 opposing to each other but it will be enough when using that at least one section of the hand grips sticks out from the side 12, 13.

The peripheral portions of the second side portions 120B, 121B such as forward ends 24, 25 and side edges 26, 27, 28, 29 are not restrained with reference to any part of the carry out bag 10.

There are provided notches 50, 51 at both ends of the center line 14 of the base portion 11 or at an adjoining corner of the respective base portions 11A, 11B.

Each notch 50, 51 is cut off to have a semicircular shape as can be seen from FIG. 7(A) when looking from the above.

Incidentally, the notches 50, 51 should be understood as to be cut off from the first side portions 20A, 21A and the second side portions 120B, 121B, too.

Figure 9:
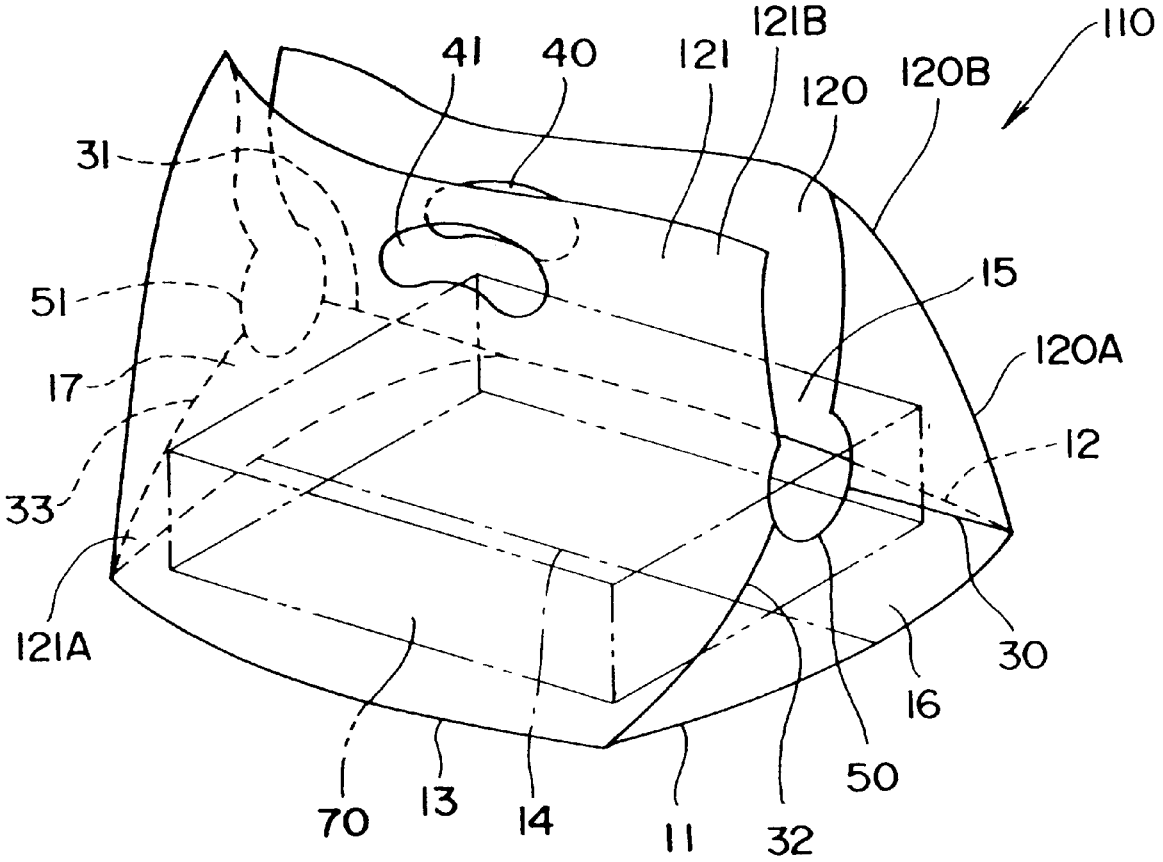
FIG. 9 is an explanatory view for a packaging method in the second embodiment.

Now referring to FIG. 9, there is shown the carry out bag 110 in use according to the present invention, in which the opening is opened enough and an article 70 is depicted by two-dotted lines is seated in the carry out bag 110.

The opening 15 of the carry out bag 110 is defined by the fold lines 22, 23 shown in FIG. 7(B) and can be formed when the respective second side portions 120B, 121B are pulled out to separate one from the other.

As shown in FIG. 9, the carry out bag 110 in use forms its side walls, that is, a triangle portion 16 of which oblique sides are made by the heat-bonded portions 30 and 32 at the side edges of the base portion 11 and an opposite triangle portion 17 of which oblique sides are made by the heat-bonded portions 31 and 33.

Below, a method of producing the above-explained carry out bag 110 will be explained with reference to the accompanied drawings.

Figure 10:
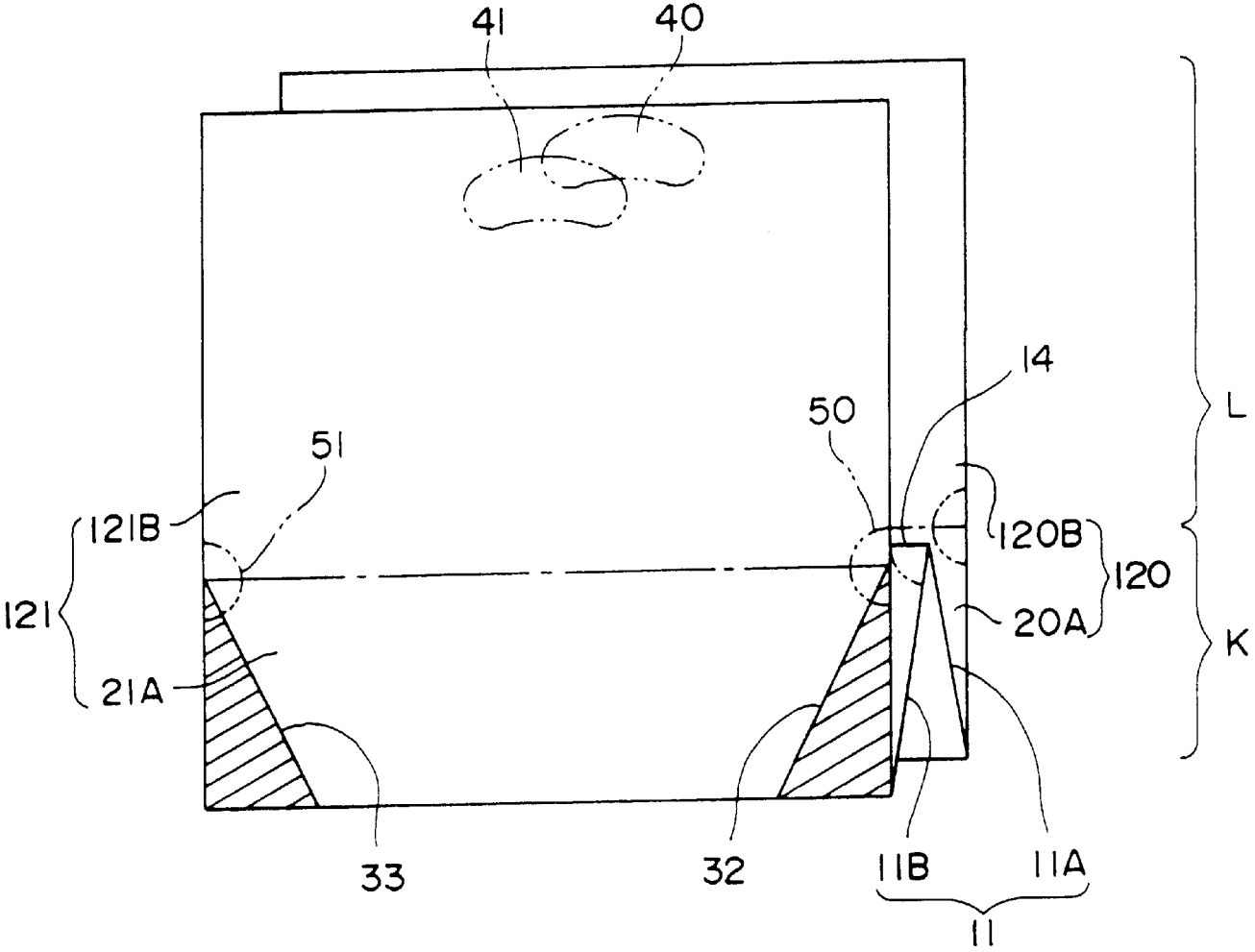
FIG. 10 is an explanatory view for a producing method in the second embodiment.

First, as shown in FIG. 10, a four-folded portion K is prepared with the base portion 11 folded along the center line 14 and the first side portions 20A and 21A as well as two-folded portion L made from the second side portions 120B and 121B. However, the base portions 11A, 11B and the first side portions 20A, 21A are not shaped into the already explained external form yet but still have a rectangular shape.

Next, the edge portions of the base portions 11A, 11B and the first side portions 20A, 21A are rectangularly heat-bonded altogether to form the respective heat-bonded portions 30–33 as shown in FIG. 10.

Thereafter, the triangle portions outside of the heat-bonded portions 30–33 hatched area in FIG. 10 are cut off.

Figure 11A:
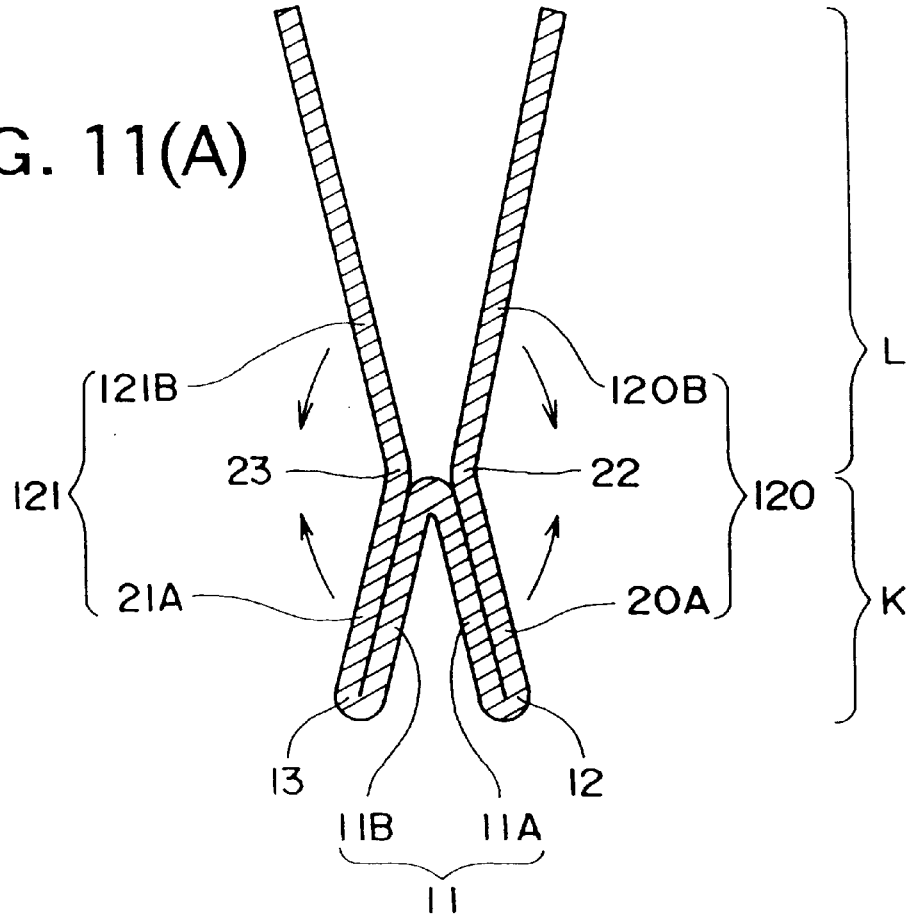
FIGS. 11(A), 11(B) are other explanatory views for the producing method in the second embodiment.
Figure 11B:
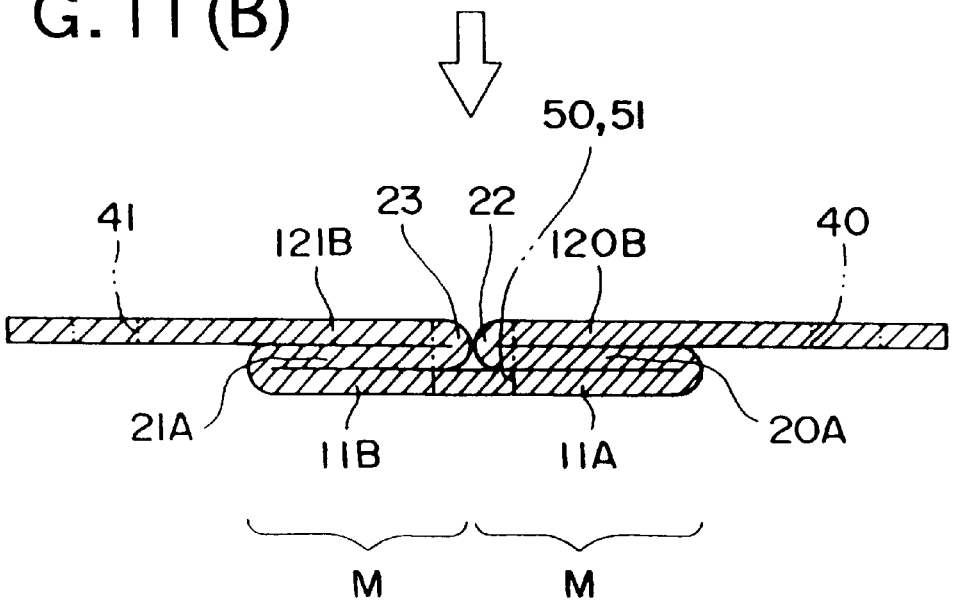

Successively, the carry out bag shown in FIG. 10 will be further processed as shown in FIGS. 11(A) and 11(B), that is, the second side portion 120B, 121B is folded along the fold lines 22, 23 described with one-dotted line and the two-folded base portion 11 is spread in almost flat state to thereby form two three-folded parts M, each being piled up with the base portion 11A, 11B, the first side portion 20A, 21A and the second side portion 120B, 121B in this order.

Processing the carry out bag as shown in FIG. 11(B), both ends portions of the fold lines 22, 23 in the three-folded parts M are cut off in a semicircular shape to have the notches 50, 51.

The second side portions 120B, 121B are further processed to have the hand grips 40, 41 outside of the three-folded parts M by being cut off in a crescent shape as can be seen from FIG. 11(B).

Incidentally, both processes to make the notches 50, 51 and the hand grips 40, 41 can be done at the same time or individually. The simultaneous making operation of the notches 50, 51 and hand grips 40, 41 can improve productivity of manufacturing the carry out bag 110.

The cut off processes for the notches 50, 51 or the hand grips 40, 41 can be carried out in a state shown in FIG. 10. The notches 50, 51 may be made by cutting off, after the above-explained cut off process at the triangle portion shown by hatching in FIG. 10, into a semicircular shape around both ends of a one-dotted border line as in FIG. 10 between the four-folded portion K and the two-folded portion L. The hand grips 40, 41 may be formed in the two-folded portion L by cutting off the second side portions 120B, 121B altogether.

A preferable using method of the carry out bag 110 according to the present invention will hereunder be explained.

The article 70 to be packaged should be put on the carry out bag 110 in a state to have the two three-folded parts M so that it is disposed on the second side portions 120B, 121B to across the fold lines 22, 23.

When packaging, both of the hand grips 40, 41 are pulled out to separate the second side portions 120B, 121B one from the other or in directions designated by the arrows E and F so as to draw out the respective side portions 120B, 121B located under the article 70.

The drawn out both second side portions 120B, 121B are pulled up straight with reference to the base portion 11 until to join the hand grips 40 and 41 together as shown in FIG. 9.

The above-described second embodiment assures the following effects additional to those in the first embodiment.

Figure 12:
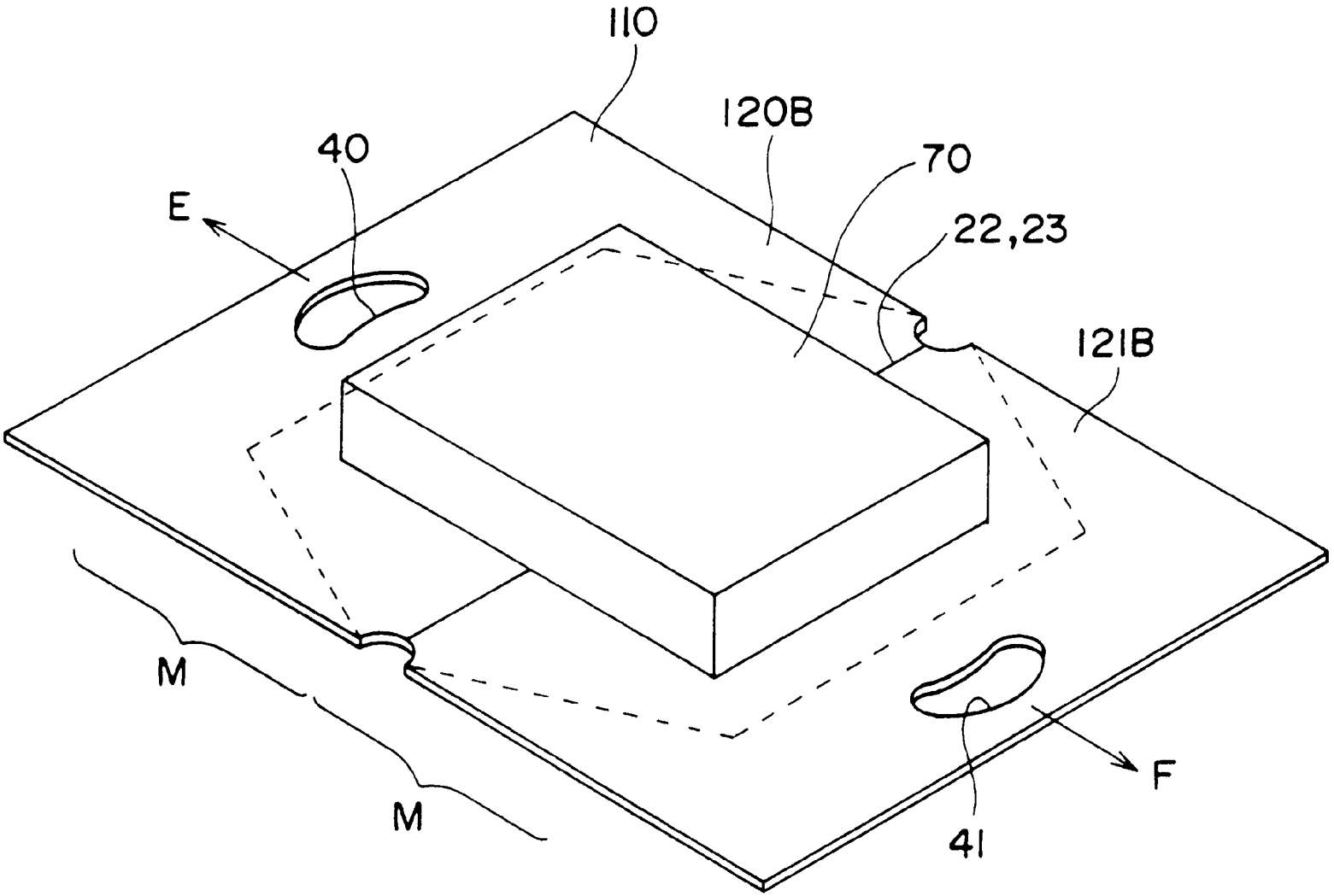
FIG. 12 is an explanatory view for a using method in the second embodiment.

As can be seen from FIG. 12, the only required operation is to pull out the second side portions 120B, 121B laterally to separate one from the other with the hand grips 40, 41 after simply putting the article 70 on the second side portions 120B, 121B, so that the whole packaging procedure can be completed with opening the opening of the carry out bag 110, which effects smooth packaging for a store clerk when a store is crowded.

The position of the hand grips 40, 41 is also preferable for users not to close the hand grips 40, 41 by the article 70 when packaging a relatively large article 70 on the second side portions 120B, 121B since they are disposed outside of the opposing two sides 12 and 13 opposing to each other. In the first embodiment, the width D of the respective second side portions 20B, 21B will be defined almost equal to or narrower than half width H of the base portion 11, so that when putting the article 70 on the respective second side portions 20B, 21B for packaging, the article 70 sometimes hide the hand grip 40, 41 because of its dimensions or set position, which decreases efficiency of packaging works. Accordingly, in the second embodiment, the second side portions 120B, 121B are reliably moved to be separated one from the other by pulling out the hand grips 40, 41, so that a more effective packaging works can be performed than that by the carry out bag 10 in the first embodiment.

The cut off process for providing the hand grip 40, 41 can be carried out easily even in a state that the three-folded parts M have already organized as depicted in FIG. 11(B) since the hand grip 40, 41 will be made outside of the opposing two sides 12, 13. It can be therefore expected for the manufacturer to arrange and simplify processes freely as a whole compared with in the carry out bag described in the first embodiment.

As may be noticed, the drawing in FIGS. 1, 7 show a state before using the carry out bag according to the present invention, but the wordings have been used based on a supposed use state.

The invention may be embodied in other specific forms without departing from the spirit or essential characteristics thereof. The present embodiments are therefore to be considered in all respects as illustrative and no restrictive, the scope of the invention being indicated by the appended claims rather than by the foregoing description, and all changes which come within the meaning and range of equivalency of the claims are therefore intended to be embraced therein.

It is not always necessary for the first side portions 20A, 21A to have a width that almost reaches the central area of the base portion 11 from the opposing two sides 12, 13 as in the foregoing embodiment. It is enough to have some width extending toward the middle area of the base portion 11, that is, in the drawings shown by FIGS. 1(A), 1(B), and FIGS. 7(A), 7(B), some space between the fold lines 22 and 23 is allowed.

The connection between the side edge of the base portion 11A, 11B and the side edge of the first side portion 20A, 21A is recommended to be done by a known heat-bonding to form the heat-bonded (sealed) portions 30, 31, 32, 33, but it may be carried out by another method such as a sewing, bonding agent or an ultrasonic waves.

As can be seen from FIGS. 1 and 7, the heat-bonded portions 30, 31, 32, 33 are angularly related at an angle of A with reference to the center line 14 of the base portion 11 or the opposing two sides 12, 13, however they can be adjusted at a right angle to the opposing two sides 12, 13. However, it is recommended to be in a range of 30–45 degrees in view of its strength, function and external appearance. The shape of the base portion 11 is generally formed into a hexagonal shape cutting slantwise, but when cutting differently it can be of a octagonal one.

As has been explained in the embodiments, the respective triangle portions, hatched area in FIGS. 4 and 10, outside of the heat-bonded portions 30, 31, 32, 33 are cut off in general, but it can be remained, if it does not care to pay attention to its external appearance.

The shape of hand grips 40, 41 in the above-mentioned embodiments is defined as to have the curved rectangular -shape but it may be of an oblong- or C-shape for convenience to receive thereinto fingers.

The hand grips 40, 41 is not limited to be shaped into a hole shape but can be replaced with a projection extended from the forward end 24, 25 of the second side portion 20B, 21B, 120B, 121B. Each set of projections are tied up to carry the carry out bag in which the article is received stably. The hand grip 40, 41 has been made by punching out the material plastic film in the embodiments, but it can be replaced with other grip such as a knot made by webs each extending from the forward end 24, 25 of the second side portion 20B, 21B, 120B, 121B or a set of hand grips each having eye to receive therein fingers.

In the foregoing embodiments, the respective side portions 20B, 21B, 120B, 121B are described to each have one hand grip 40, 41, but it is naturally allowed to have more than two hand grips. Taking for an instance to have one more hand grip horizontally in relation to the normal hand grip 40, 41 shown in FIGS. 3 and 10, the horizontally aligned hand grips will expand a choice of hand grips upon height of the article 70.

The shape of the base portion 11 is defined as to be an almost hexagonal shape in the foregoing embodiments, but it may be of other shapes having opposing two sides 12, 13 and heat-bonded portions 30, 31, 32, 33 near the side edges.

It is therefore possible for the first side portions 20A, 21A to have other shapes.

In the embodiments, the second side portions 20B, 21B, 120B, 121B are defined to have a rectangular shape but since the forward end 24, 25 and side edge 26, 27, 28, 29 of the second side portion 20B, 21B, 120B, 121B do not relate with other portions of the carry out bag 10, 110. Thus, the shape of the forward end 24, 25 and the side edge 26, 27, 28, 29 can be defined differently and that of the second side portions 20B, 21B, 120B, 121B is also allowed to have different shapes.

For example, the side edges 26, 27, 28, 29 may be angularly formed to almost meet the heat-bonded portion 30, 31, 32, 33 to shape the second side portion 20B, 21B, 120B, 121B into the same shape as the first side portion 20A, 21A.

Each notch 50, 51 is defined as to be a semi-circular shape in the embodiments, but it can be of any shape.

The notches 50, 51 may not be provided, but it is preferable to be provided to improve easy opening and strength.

The carry out bag 10, 110 is made of plastic film in the embodiments, however its material should not be limitedly understood but may be of cloth, paper and the like.

Thickness of the carry out bag is also optional. The described thickness of the carry out bag 10, 110 in FIGS. 1(B), 5(A), 5(B), 6, 7 (B), 11(A), 11(B) is exaggerated for explanation.

The producing method and using method of the carry out bag in accordance with the present invention are not necessary to be limited into those of the already explained embodiment. Referring to the producing method the cut off process of the triangle portion, hatched are in FIGS. 4, 10, outside of the heat-bonded portion 30, 31, 32, 33 can be carried out after the formation of the notch 50, 51. In the using method, the article 70 may be put into the carry out bag which is already opened by pulling out the second side portions 20B, 21B, 12B, 121B to be separated one from the other in a direction E and F respectively in FIGS. 6, 12.

The carry out bag according to the present invention can be applied to package foods such as takeout lunch box, cake, hamburger, fried chicken, takeout dish, Japanese and western cake, expensive fruit, pizza, sliced raw fish, and various goods, products and articles. Particularly, the carry out bag is preferable to package any box type object made of synthetic resin, paper or wood and covered with a simple packaging.

Accordingly, the side portions of the carry out bag are originally folded to smoothly and easily open the carry out bag to receive thereinto the article, keep the article flat on the base portion, so that a stable transportation of the goods is reliably taken place and the bulk when plural carry out bags 10 are piled up can be lessened, which will be advantageous for keeping and transporting them. The using state surely presents a good appearance which effects advertising effect. As has been mentioned above, according to the present invention, as the hand grips of the second side portions are provided outside of the opposing two sides as fold lines between the base portion and the first side portion, when the article put on the second side portions, the hand grips are not blocked up under the article, so that the packaging can be improved, and the cut out process of the hand grips can be finished in a three-folded state of the carry out bag to thereby simplify total steps for producing.

What is claimed is:

1. A method of manufacturing a carry out bag from a sheet of material, said method including the step of:

forming the sheet of material so that the sheet has four consecutive folds wherein: a first fold forms a first side of the bag, a second fold borders the first fold and forms a first half of a bag base; a third fold borders the second fold and forms a second half of the bag base; a fourth fold borders the third fold and forms a second side of the bag; and, as a result of said forming, the second and third folds are located between the first and fourth folds;

forming the sides of the bag so that each side has two portions wherein: the first side has a first portion adjacent the first half of the bag base and a second portion spaced from the bag base; and the second side has a first portion adjacent the second half of the bag base and a second portion spaced from the bag base, wherein, said forming of the sides is performed so that the second and third folds forming the bag base are not located between the second portions of the sides;

bonding the first side first portion to the first half of the bag base and bonding the second side first portion to the second half of the bag base;

folding the sides so that each side second portion overlies the first portion from which the second portion extends, and separating the halves of the bag base so that the bag base halves are in a common plane wherein: the first side first portion is folded over the first half of the bag base; the first side second portion is folded over the first side first portion; the second side first portion is folded over the second half of the bag base; and the second side second portion is folded over the second side first portion.

2. The method of manufacturing a carry out bag of claim 1, wherein, in said bonding step: bonds are formed between the first side first portion and the first half of the bag base along bond lines that are angularly offset from a center line separating the first half of the bag base from the second half of the bag base; and bonds are formed between the second side first portion and the second half of the bag base along bond lines that are angularly offset from the center line.

3. The method of manufacturing a carry out bag of claim 2, wherein, in said bonding step, the bond lines are formed to extend from an angle between 30 to 45° from the center line.

4. The method of manufacturing a carry out bag of claim 1, wherein, prior to said bonding step, outer sections of the side first portions and the bag base halves that would be bonded together are cutaway so that, after said bonding step, the bag is formed to define opposed notches where outer sections of the sides and the bag base meet.

5. The method of manufacturing a carry out bag of claim 4, wherein, in said cutting step, semicircular sections of the sides are cutaway.

6. The method of manufacturing a carry out bag of claim 1, further including the step of forming in the sides hand grips.

7. The method of manufacturing a carry out bag of claim 6, wherein, prior to said bonding step, outer sections of the side first portions and the bag base halves that would be bonded together are cutaway so that, after said bonding step, the bag is formed to define opposed notches where outer sections of the sides and the bag base meet.

8. The method of manufacturing a carry out bag of claim 7, where said step of forming hand grips is performed simultaneously with said step of cutting away the side first portions and the bag base halves.

9. The method of manufacturing a carry out bag of claim 1, wherein the sheet of material from which the bag is formed is one selected from the group consisting of: plastic; cloth; and paper.

* * * * *